United States Patent [19]

Herrmann et al.

[11] Patent Number: 5,007,970

[45] Date of Patent: Apr. 16, 1991

[54] PROCESS FOR THE CLEANING OF STEAM GENERATOR HEATING SURFACES

[75] Inventors: Hellmut A. Herrmann, Kassel; Wolfgang Hubeler, Staufenberg, both of Fed. Rep. of Germany

[73] Assignee: Schmidt'sche Heissdampf GmbH, Kassel-Bettenhausen, Fed. Rep. of Germany

[21] Appl. No.: 188,314

[22] Filed: May 2, 1988

[30] Foreign Application Priority Data

May 2, 1987 [DE] Fed. Rep. of Germany ..... 3714673

[51] Int. Cl.[5] ..... B08B 3/14

[52] U.S. Cl. ..... 134/42

[58] Field of Search ..... 134/1, 183, 25.1, 25.4, 134/183, 42; 165/47; 122/379; 15/316, 317

[56] References Cited

U.S. PATENT DOCUMENTS

| | | | |
|---|---|---|---|
| 3,507,257 | 4/1970 | Broadent | 122/379 |
| 3,664,310 | 5/1972 | Locke, Sr. et al. | 122/379 |
| 3,721,217 | 3/1973 | Willach et al. | 122/379 |
| 3,782,336 | 1/1974 | Nelson | 122/379 |
| 3,845,813 | 1/1975 | Bougard | 134/183 |

*Primary Examiner*—Curtis R. Davis

*Attorney, Agent, or Firm*—Chilton, Alix & Van Kirk

[57] ABSTRACT

In a process for the mechanical cleaning of heat exchange surfaces of an evaporator or superheater of a steam generator, a dust-laden hot waste gas being passed through the steam generator, the formation of adhesive deposits on the heat exchange surface is prevented by lowering surface temperature at least at the beginning of a cleaning cycle. The surface temperature will be reduced to below the softening temperature of the material being deposited whereby such material forms hard deposits which may be loosened from the surfaces by mechanical means such as vibration.

8 Claims, No Drawings

PROCESS FOR THE CLEANING OF STEAM GENERATOR HEATING SURFACES

BACKGROUND OF THE INVENTION

1. Field of the Invention

The present invention relates to enhancing the efficiency of operation of heat exchangers and particularly to cleaning the heat transfer surfaces of a device utilized to transfer thermal energy from a flowing gas to another fluid medium. More specifically, this invention is directed to facilitation of the removal of solid matter which collects on heating surfaces, for example the evaporator or superheater heating surfaces of steam generators, that are exposed to hot gases having particulate matter entrained therein. Accordingly, the general objects of the present invention are to provide novel and improved methods of such character.

2. Description of the Prior Art

While not limited thereto in its utility, the present invention is particularly well suited for employment in those industrial processes where waste heat is utilized to generate steam. In such processes, a dust-laden hot gas may be directed through a steam generator for the purpose of extracting thermal energy from the gas while simultaneously cooling the gas prior to its further treatment and ultimate release to the atmosphere. The efficiency of operation of a steam generator is a direct function of the cleanliness of the heat transfer surfaces of the device. Thus, since solid matter condensed from and/or particular matter entrained in the hot waste gas and deposited on the heat exchange surfaces will seriously degrade heat transfer efficiency, provision for cleaning the steam generator must be made.

In the prior art, in order to ensure continuous steam generator operation and, consequently, as uniform a steam emission as possible, various cleaning methods have been employed. These prior art cleaning methods include:

(a) cleaning of the heating surfaces by means of blast lances;
(b) ball rain cleaning;
(c) knocking;
(d) cleaning by shaking and/or striking;
(e) sonic cleaning.

As will be briefly discussed below, all of the above-listed prior art cleaning techniques have been found to have the disadvantage of being ineffective under certain circumstances.

With respect to the use of blast lances, also referred to as sootblowing, the technique is often ineffective. This lack of effectiveness, in many cases, results from the fact that the steam generator will be employed in an environment where foreign media, for example steam, air or inert gas, cannot be blasted due to production reasons or the danger of corrosion.

The mechanical cleaning methods of techniques (b),(c),(d) and (e) above require, for operation, a mechanical impact on the surfaces to be cleaned. However, such mechanical impact will result in removal of deposits from the surface only if such deposits are dry and/or have hardened on the surface and thus are to some extent brittle. In many environments, the deposits which are formed on the steam generator heat exchange surfaces are adhesive and thus do not harden on such surfaces. These adhesive deposits, which do not harden and consequently become brittle, cannot be removed by impact or by vibration and, in time, will cause an interruption of steam generator operation.

In many cases, the temperature of the heating surface will determine whether any impurities deposited from the hot waste gas will harden on the surface, i.e., steam generator heat exchange surface temperature will determine the effectiveness of the mechanical cleaning methods. Line pressures and steam conditions in complicated, large facilities are often not freely chosen and steam pressures and steam super-heating temperatures are commonly used which result in a steam generator heat exchange surface temperature that remains above the softening point of the deposits formed thereon. Accordingly, such deposits are effectively adhesive contaminations.

SUMMARY OF THE INVENTION

The present invention overcomes the above briefly described and other deficiencies and disadvantages of the prior art by providing a novel method which facilitates the removal of adhesive deposits on a heat exchange surface subjected to a dirty waste gas and, further, which makes possible the cleaning of such surfaces by conventional mechanical techniques without interruption of the operation of the steam generator or other heat exchanger. In accordance with the invention, the surface temperature of the heat exchange surfaces to be cleaned is either maintained at or, immediately prior to a cleaning cycle, lowered below the softening temperature of the deposits on such surface. In the case of a steam generator, such a lowering of heating surface temperature may, for example, be accomplished by lowering evaporator pressure or superheating temperature.

DESCRIPTION OF THE PREFERRED EMBODIMENTS

In the practice of the present invention, the heating surface temperature at which the hardening of matter deposited thereon from the waste gas stream is determined for the particular application. In the case of a steam generator, if possible the operating steam pressure is set such that the heating surface temperature will be at a level where the hardening of deposited matter will occur, at the latest, during the settling of matter entrained in the waste gas stream on the heating surface. In the case of steam superheating surfaces, the superheating temperature must analogously be limited, if necessary, in order to cause a hardening of the particles entrained in the waste gas stream prior to or immediately upon their deposit on the surfaces. The lowering of the heating surface temperature is preferably accomplished by spraying water into the hot steam. Thus, one or more spray coolers should be connected in the steam path and water should be injected for a short period at the beginning of each cleaning cycle. The method of the present invention has the advantage that deposits that are hardened can be removed by the above-identified mechanical cleaning techniques and such cleaning techniques are capable of being practiced independently of the normal operating conditions of a steam generator, i.e., evaporator pressure and superheating steam temperature.

In accordance with one reduction to practice, the invention was employed in a process for the production of sulphuric acid. In this utilization, metal sulfides were roasted with oxygen from air in fluidized bed ovens. This roasting produced a hot waste gas which was rich in $SO^2$ and heavily dust-laden. The dust content of the oven waste gases was 150 to 500 g/m$^3$. The dust was a mixture of many substances in the near-eutectic range and having a softening point below 450° C. In order to ensure the hardening of the deposits formed on the steam generator heating surfaces, a steam superheating temperature in the range of 380°–400° C. was used with a steam pressure in the range of 40–60 bar.

In some cases where utilization of the present invention is desired, a superheating temperature of higher than 500° C. is required. Under these circumstances, adhesive deposits on the end superheater often result and these adhesive deposits cannot be removed by means of conventional heating surface vibrating devices. However, by spraying feed-water from a spray cooler positioned before the end superheater, its surface temperature can be temporarily lowered to below 450° C. As a result of the lowering of the steam generator heating surface temperature, deposits on the surface become hardened, i.e., shells are formed which can be removed by shaking.

While preferred embodiments have been described, various modifications and substitutions may be made thereto without departing from the spirit and scope of the invention. Accordingly, it is to be understood that the present invention has been described by way of illustration and not limitation.

What is claimed is:

1. In a process for causing the removal of deposits from the surface of a heat exchange device by mechanical cleaning, the improvement comprising lowering the temperature of the surface to be cleaned below the softening temperature of the deposited material to be removed therefrom, at least for a period at the beginning of a cleaning cycle whereby the deposits will be hardened so as to be capable of mechanical removal.

2. The process of claim 1 wherein the heat exchanger is a steam generator and wherein the mechanical removal process comprises vibrating the surfaces from which the deposits are to be removed.

3. The process of claim 1 wherein the heat exchanger is a steam generator having an evaporator and wherein the lowering of the temperature is accomplished by reducing the evaporator pressure.

4. The process of claim 1 wherein the heat exchanger is a steam generator including a superheater and wherein the lowering of the surface temperature comprises reducing the super heating temperature.

5. The process of claim 3 wherein the mechanical removal is accomplished by vibrating the surface to be cleaned.

6. The process of claim 4 wherein the mechanical removal is accomplished by vibrating the surface to be cleaned.

7. The process of claim 4 wherein the reduction of the surface temperature is accomplished by providing a spray cooler before the superheater and by spraying water from the spray cooler.

8. The process of claim 6 wherein the reduction of the surface temperature is accomplished by providing a spray cooler before the superheater and by spraying water from the spray cooler.

* * * * *